US006264512B1

(12) United States Patent
Müller

(10) Patent No.: US 6,264,512 B1
(45) Date of Patent: Jul. 24, 2001

(54) COMBINED THROTTLE AND PROPELLER-PITCH CONTROL FOR BOAT

(75) Inventor: Peter Müller, Adliswil (CH)

(73) Assignee: Nasyc Holding S.A., Luxembourg (LU)

( * ) Notice: Subject to any disclaimer, the term of this patent is extended or adjusted under 35 U.S.C. 154(b) by 0 days.

(21) Appl. No.: 09/632,658

(22) Filed: Aug. 4, 2000

(30) Foreign Application Priority Data

Aug. 5, 1999 (DE) ..... 199 36 946

(51) Int. Cl.[7] ..... B63H 3/00

(52) U.S. Cl. ..... 440/50; 440/84; 440/87; 416/273

(58) Field of Search ..... 440/50, 84, 85, 440/86, 87; 416/27

(56) References Cited

U.S. PATENT DOCUMENTS 3,709,187 * 1/1973 Marco et al. ..... 440/50
3,724,970 * 4/1973 Kobelt ..... 416/27
3,826,590 * 7/1974 Kobelt ..... 416/27

FOREIGN PATENT DOCUMENTS 3808237 9/1989 (DE) .
0485745 5/1992 (EP) .

OTHER PUBLICATIONS

Periodical: "Yacht" Aug. 1983, pp. 114 & 115.

* cited by examiner

*Primary Examiner*—Stephen Avila
(74) *Attorney, Agent, or Firm*—Herbert Dubno; Andrew Wilford

(57) ABSTRACT

A boat drive having a variable-speed engine connected through a clutch to a variable-pitch propeller has a control having a housing and a guide on the housing defining a central crosswise track having a travel end and a start end, forward and backward travel tracks extending from the travel end, and a forward start track extending from the start end. A lever pivoted on the housing is movable in the tracks of the guide. A pitch controller connected to the propeller includes a position detector operable by the lever when in the travel end and travel tracks for increasing propeller pitch positively on movement of the lever forward from the travel end in the forward travel track and negatively on movement of the lever backward from the travel end in the backward track and for setting the propeller at 0° pitch when the lever is in the travel end. An engine controller connected to the engine and to the clutch includes a position detector operable by the lever when in the start track for opening the clutch and varying engine speed in accordance with movement of the lever along the start track.

13 Claims, 2 Drawing Sheets

COMBINED THROTTLE AND PROPELLER-PITCH CONTROL FOR BOAT

FIELD OF THE INVENTION

The present invention relates to a control for a boat. More particularly this invention concerns a system for jointly controlling the engine throttle, the pitch of a variable-pitch propeller, and a clutch connecting the propeller to the engine.

BACKGROUND OF THE INVENTION

A lever-type control for a boat having a variable-pitch propeller is standard. As the lever is tipped forward, the propeller pitch is increased in a forward direction to move the boat forward, and when the lever is tipped backward the propeller-vane pitch is reversed to move the boat backward. In a central neutral position the propeller pitch is null so that, even if the propeller is rotating, the boat will not move. The lever is often associated with a throttle control that increases engine speed as pitch exceeds a certain level.

In small motor boats used for sport or fishing purposes and having a variable-pitch propeller it is normally only possible to increase the pitch in the forward direction; pitch settings for reverse are not available. A transmission and clutch are provided between the engine and the propeller for reversing it. Controlling such a system is fairly complex, in particular for starting which requires special settings so that engine does not have to start under load. Furthermore in many small-boat systems when the lever is in the central neutral position, the propeller continues to rotate, albeit at 0° pitch so that the boat does not move, but the rotating propeller still presents a hazard for swimmers who might want to board the boat over the stern.

OBJECTS OF THE INVENTION

It is therefore an object of the present invention to provide an improved control for a boat having a variable-pitch propeller connected via a clutch to a drive engine.

Another object is the provision of such an improved control for a boat drive which overcomes the above-given disadvantages, that is which allows easy control of the boat for forward and reverse movement, and easy and save starting of the engine.

SUMMARY OF THE INVENTION

A boat drive having a variable-speed engine connected through a clutch to a variable-pitch propeller has a control having according to the invention a housing and a guide on the housing defining a central crosswise track having a travel end and a start end, forward and backward travel tracks extending from the travel end, and a forward start track extending from the start end. A lever pivoted on the housing is movable in the tracks of the guide. A pitch controller connected to the propeller includes a position detector operable by the lever when in the travel end and travel tracks for increasing propeller pitch positively on movement of the lever forward from the travel end in the forward travel track and negatively on movement of the lever backward from the travel end in the backward track and for setting the propeller at 0° pitch when the lever is in the travel end. An engine controller connected to the engine and to the clutch includes a position detector operable by the lever when in the start track for opening the clutch and varying engine speed in accordance with movement of the lever along the start track.

Thus with this system when the lever is in the travel tracks, simple intuitive backward and forward movement of the lever will control the boat's forward and backward movement. When in the start track, however, the engine can be started and, according to the invention, even revved, but the engine is disconnected by the clutch from the propeller so that no boat movement will result.

The guide in accordance with the invention is h-shaped. More particularly the forward tracks are parallel to each other and the backward travel track is in line with the forward travel track. This produces a very easy to learn and use control pattern.

The engine controller also increases engine speed when the lever is moved from the travel end forward in the forward travel track and backward in the backward travel track. Normally, however, the engine speed is only increased after the lever is moved in the travel tracks a predetermined distance from the travel end. Thus the boat will start gently, whether going forward or backward.

According to the invention a spring urges the lever along the crosswise track into the start end. Thus if the lever is released when in a center position, it will automatically slip into the start null position in which the clutch is opened.

The guide in accordance with the invention is a plate formed with slots defining the tracks and along which the lever is movable. The lever has a shaft pivoted in the housing and extending parallel to the crosswise track. The lever is pivotal on the shaft about an axis lying in a plane parallel to the forward and backward tracks.

The engine controller includes a switch operated by the lever when in the start track for allowing the engine to be started. The pitch controller includes a switch operated by the lever when in the start track for opening the clutch. In addition this pitch controller includes a switch operated by the lever when in the travel tracks for closing the clutch.

In order to allow the user to release the lever when under way, a ratchet is provided for releasably retaining the lever in any of a plurality of offset positions in the travel tracks. This ratchet includes a wheel connected to the lever and having a toothed periphery and a spring-loaded element mounted in the housing and engaging the periphery.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
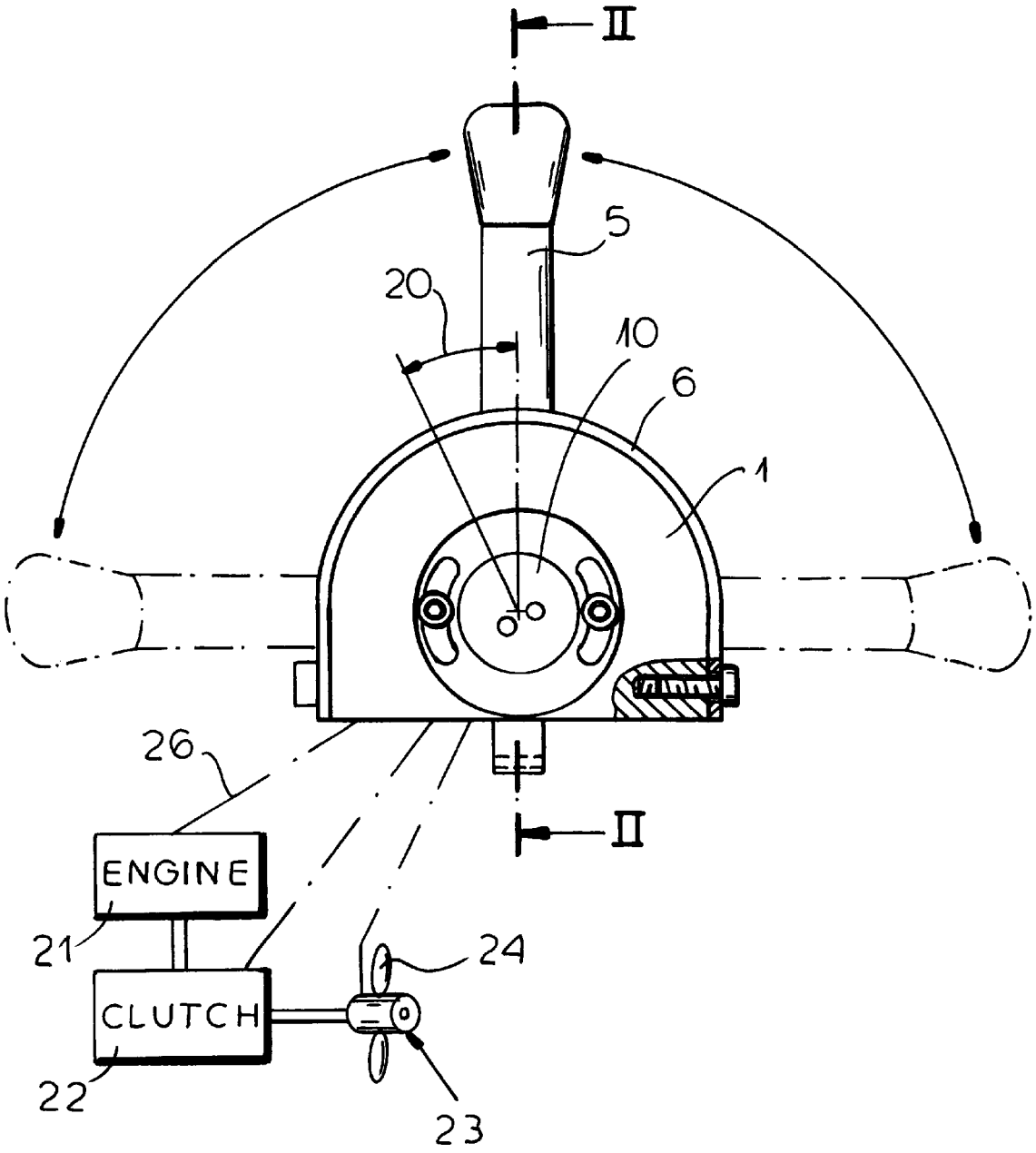
FIG. 1 a partly diagrammatic and partly sectional side view of the control according to the invention.
Figure 2:
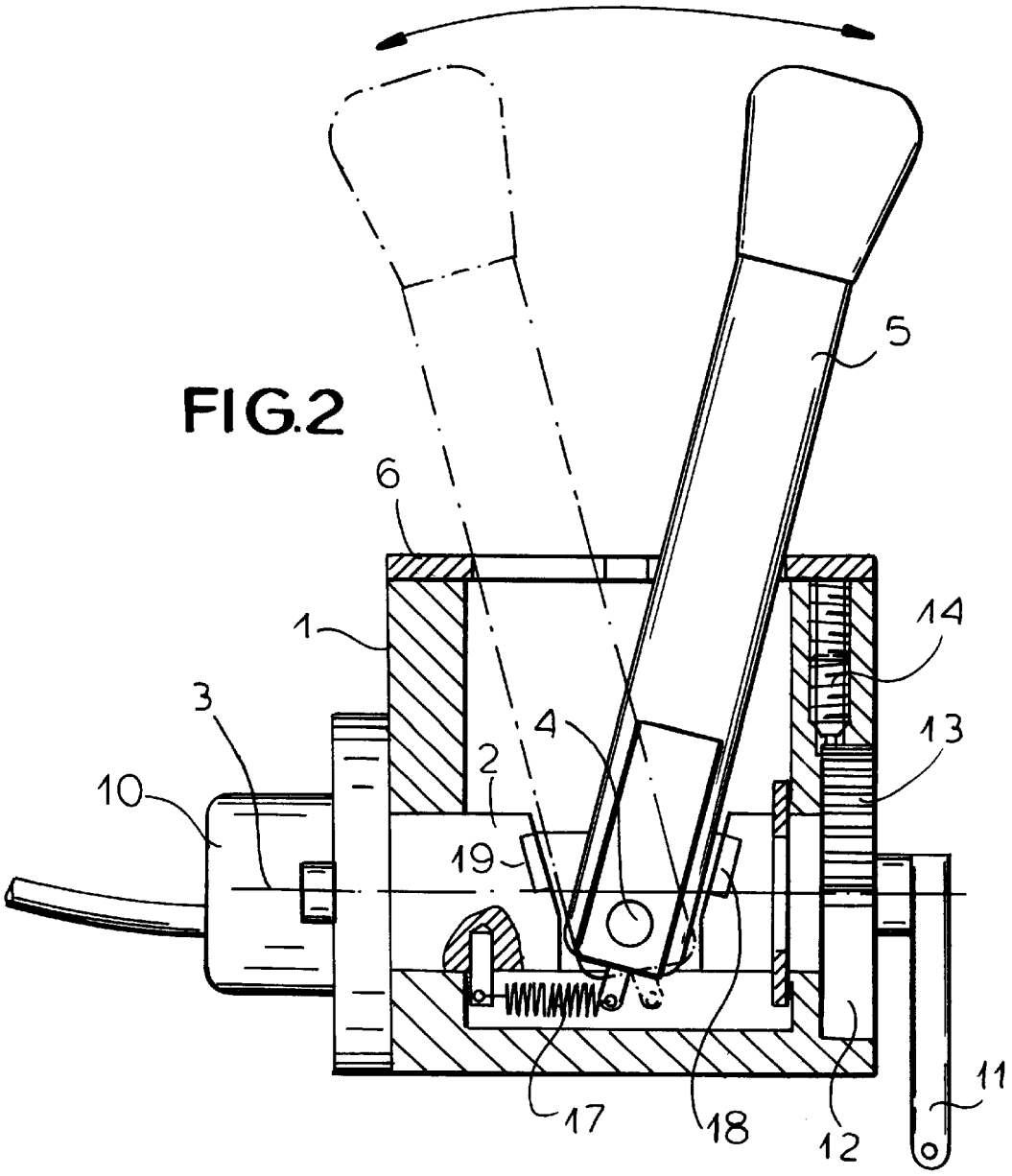
FIG. 2 a section taken along line II—II of FIG. 1.
Figure 3:
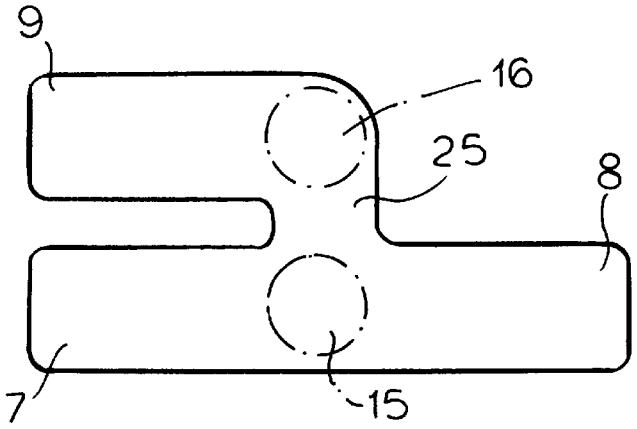
FIG. 3 a schematic view illustrating the tracks of the control lever of the system in accordance with the invention.

As seen in FIGS. 1 and 2, a control housing 1 holds a shaft pivotal about a main axis 3 and carrying a lever 5 pivotal with the shaft and also pivotal on the shaft about a transverse auxiliary axis 4 lying in a plane perpendicular to the axis 3. The housing 1 carries an arcuate plate 6 into which is cut an H-shaped guide having forward and back in-line travel tracks 7 and 8 and, offset therefrom, a start track 9, interconnected by a crosswise track 25 extending from a null position 15 between the tracks 7 and 8 and a null position 16 at the starting end of the track 9.

The shaft 2 directly drives a potentiometer 10 that is connected via an appropriate actuator to a variable-pitch propeller 23 having vanes 24 (FIG. 1) and via a radially projecting arm 11 and bowden cable illustrated schematically at 26 (FIG. 1 also) to a boat engine 21. In addition the shaft 2 is fixed to a wheel 12 having a toothed periphery 13 engaged by a spring-loaded element 14 carried in the housing 1 and bearing radially inward of the axis 3 on the wheel 13 to hold it in any of a multiplicity of angularly offset positions.

In the null position 16 the lever 5 actuates a normally open switch 18 that is connected to the engine 21 such that the engine 21 can only be started when the lever 5 is actuating this switch 18. In addition the switch 18 is connected to a clutch 22 connecting the engine 21 to the propeller 23 so that in the position 16 the clutch 22 is also open, disconnecting the prop 23 from the engine 21. Movement of the lever 5 forward in the start track 9 opens the engine's throttle, revving it. A spring 17 hooked to the lower end of the lever 5 urges it into this null position 16. In the position 15 a switch 19 is operated that closes the clutch 22 connected between the engine 21 and the propeller 23. In this position 15 or when in the tracks 7 and 8, the engine starter cannot be operated.

Thus when the lever 5 is moved against the force of the spring 17 into the start track 9, the engine 21 can be started and, by movement of the lever 4 forward in the track 9, revved while wholly disconnected from the prop.

When in the opposite side of the guide 6 the lever 5 can be pushed forward in the track 7 to increase the propeller pitch in a positive manner to move the boat forward. After the lever 5 has moved forward through a small arc indicated at 20 in this position, the engine speed is also increased, synchronously with pitch change of the propeller. When pulled back in the track 8 the engine speed is also increased, but the propeller pitch is increased negatively to back up the boat. When moving from forward to rearward movement, the engine speed is automatically dropped to idle as the lever passes through position 15, and the propeller pitch is automatically passed through a 0° pitch. The operation is intuitive and basically foolproof.

If the lever 5 is released in the null position 15, the spring 17 will pull it over to the position 16 which opens the clutch 22 so that accidental movement of the lever 5 will not cause the boat to lurch forward.

I claim:

1. In a boat drive having a variable-speed engine connected through a clutch to a variable-pitch propeller, a control comprising:

a housing;

a guide on the housing defining a central crosswise track having a travel end and a start end, forward and backward travel tracks extending from the travel end, and a forward start track extending from the start end;

a lever pivoted on the housing and movable in the tracks of the guide;

pitch-control means connected to the propeller and including a position detector operable by the lever when in the travel end and travel tracks for increasing propeller pitch positively on movement of the lever forward from the travel end in the forward travel track and negatively on movement of the lever backward from the travel end in the backward track and for setting the propeller at 0° pitch when the lever is in the travel end; and engine-control means connected to the engine and to the clutch and including a position detector operable by the lever when in the start track for opening the clutch and varying engine speed in accordance with movement of the lever along the start track.

2. The boat drive defined in claim 1 wherein the guide is h-shaped.

3. The boat drive defined in claim 1 wherein the forward tracks are parallel to each other and the backward travel track is in line with the forward travel track.

4. The boat drive defined in claim 1 the engine-control means also increases engine speed when the lever is moved from the travel end forward in the forward travel track and backward in the backward travel track.

5. The boat drive defined in claim 4 wherein the engine speed is only increased after the lever is moved in the travel tracks a predetermined distance from the travel end.

6. The boat drive defined in claim 1, further comprising spring means urging the lever along the crosswise track into the start end.

7. The boat drive defined in claim 1 wherein the guide is a plate formed with slots defining the tracks and along which the lever is movable.

8. The boat drive defined in claim 1 wherein the lever has a shaft pivoted in the housing and extending parallel to the crosswise track, the lever being pivotal on the shaft about an axis lying in a plane parallel to the forward and backward tracks.

9. The boat drive defined in claim 1 wherein the engine-control means includes a switch operated by the lever when in the start track for allowing the engine to be started.

10. The boat drive defined in claim 1 wherein the pitch-control means includes a switch operated by the lever when in the start track for opening the clutch.

11. The boat drive defined in claim 1 wherein the pitch-control means includes a switch operated by the lever when in the travel tracks for closing the clutch.

12. The boat drive defined in claim 1 further comprising ratchet means for releasably retaining the lever in any of a plurality of offset positions in the travel tracks.

13. The boat drive defined in claim 12 wherein the ratchet means includes a wheel connected to the lever and having a toothed periphery and a spring-loaded element mounted in the housing and engaging the periphery.

* * * * *